US005758781A

United States Patent [19]

Lord et al.

[11] Patent Number: 5,758,781

[45] Date of Patent: Jun. 2, 1998

[54] DISPLAY APPARATUS

[75] Inventors: Christopher Michael Lord; Tony Blackmore, both of West Yorkshire, England

[73] Assignee: Barkston Plastics Display Limited, West Yorkshire, England

[21] Appl. No.: 643,317

[22] Filed: May 6, 1996

[51] Int. Cl.[6] ..... A47F 7/00

[52] U.S. Cl. ..... 211/55; 211/128.1

[58] Field of Search ..... 211/55, 56, 128, 211/129

[56] References Cited

U.S. PATENT DOCUMENTS

| | | | |
|---|---|---|---|
| 4,613,047 | 9/1986 | Bushyhead et al. | 211/128 X |
| 4,871,218 | 10/1989 | Swinson | 211/55 X |
| 4,905,845 | 3/1990 | Boeker et al. | 211/128 X |
| 4,938,366 | 7/1990 | Carroll | 211/128 X |
| 5,009,335 | 4/1991 | Jonker | 211/55 |
| 5,105,952 | 4/1992 | Krattiger | 211/94 X |
| 5,222,609 | 6/1993 | Eaton | 211/55 |
| 5,390,801 | 2/1995 | Hansen | 211/55 |
| 5,447,242 | 9/1995 | Kelly et al. | 211/128 X |
| 5,485,928 | 1/1996 | Felton | 211/128 X |
| 5,575,396 | 11/1996 | Smed | 211/55 X |

FOREIGN PATENT DOCUMENTS

| | | | |
|---|---|---|---|
| 0295869 A2 | 12/1988 | European Pat. Off. . | |
| 2614427 | 10/1977 | Germany | 211/55 |
| 1482997 | 8/1977 | United Kingdom | 211/55 |
| 2034579 | 6/1980 | United Kingdom | 211/55 |

*Primary Examiner*—Leslie A. Braun
*Assistant Examiner*—Donald J. Wallace
*Attorney, Agent, or Firm*—Adams Law Firm, P.A.

[57] ABSTRACT

The display apparatus 2 comprises a cascading display device 4 which defines three elongate channels 6, 8, 10 in which articles, for example magazines or newspapers, may be arranged and displayed. The display device 4 is supported by a support device 12 which extends between a rear wall 14, situated behind the device 4, and the display device and is arranged to support the display device against downwards movement. The support device includes a support flange 78 which extends into a gap defined between limbs 34, 36 of respective channels 6, 8. Support rods 16 extend between the wall 14 and the display device 4 and are arranged to space the display device 4 from the wall 14; to prevent the display device 4 from pivoting about the support device 12; and to add rigidity to the display apparatus. In another embodiment, a support device is provided which includes support flanges which extend into respective gaps defined between the first and second channels 6, 8 and the second and third channels 8, 10.

7 Claims, 4 Drawing Sheets

3/4
40
38
8
36
91
92
34
6
32
20
94
28
30
90
72

106
98
104
110
99
102
96
94
90
100

108
99
112
114

DISPLAY APPARATUS

This invention relates to display apparatus and particularly, although not exclusively, relates to display apparatus for displaying flat articles, for example magazines, newspapers, brochures, stationery, greetings cards, post cards, hosiery and video cassette tapes.

European Patent Number 0 295 869 (Eolas) discloses a display unit for articles which comprises a plurality of elongate J-shaped cross-section channels suspended one from the other. The free end of the longer limb of the uppermost J-shaped channel defines a hook arrangement which engages a wall hook which is fixed to a wall, so that the uppermost J-shaped channel (and each lower J-shaped channel) is supported in position against downwards movement away from the wall.

One problem associated with the display unit described is that all of the weight of the J-shaped channels is incident upon and, therefore, must be supported by, the engaged hook arrangement of the uppermost channel and the wall hook, and consequently, one or both of the hooks may break and/or become distorted over time, particularly if the unit is supporting a relatively heavy load.

Another problem associated with the display unit described is that the unit may sag under heavy loads. This may be detrimental when a first display unit is fixed above a second display unit, since the sagging of the first display unit may result in articles which are displayed in an uppermost J-shaped channel of the second display unit being partially obscured by the first unit. Additionally, when two of the display units described are arranged side by side with adjacent J-shaped channels of the units being generally in line with one another in order to define a continuum therebetween, differences in the extent of sagging of one of the units relative to the other will lead to the continuity between the adjacent units being distorted and, therefore, the units will appear uneven.

A further problem associated with the display unit described is that the hook-shaped free ends of the channels project slightly into the area of the channels in which articles are received for display. The free ends may be relatively sharp and may, therefore, damage articles, for example magazines, when they are inserted into or removed from the channels.

Preferred embodiments of the present invention aim to alleviate problems associated with known display apparatus.

According to the invention, there is provided display apparatus comprising a plurality of elongate article supports for supporting articles to be displayed, said article supports being arranged to define a tiered arrangement having an upper end and a lower end, support means being provided for supporting the tiered arrangement against downwards movement, said support means being arranged to be secured relative to a fixed structure and to engage the tiered arrangement at a position below the upper end thereof.

Each of the said article supports is preferably of channel cross-section. Preferably, at least two, more preferably at least three article supports of channel cross-section are provided. Each of said article supports preferably includes a first limb and a second limb. Said first limb is preferably longer than said second limb. Said first limb and said second limb preferably extend substantially parallel to one another. A base member preferably extends between said first and second limbs. Said base member preferably extends perpendicularly to the first and second limbs.

Said article supports preferably define first and second channel sections, wherein the first channel section is above the second channel section. Said second channel section is preferably in front of the first channel section. Preferably, a said first limb of the second channel section extends parallel to a second limb of the first channel section. Preferably, a part of said first limb of the second channel section is superimposed upon said second limb of the first channel section. A gap is preferably defined between the first and second channel sections, for example between the second limb of the first channel section and the first limb of the second channel section. Said gap is preferably elongate and suitably has a width which is less, preferably by a factor of at least five, more preferably by a factor of at least ten, than the width of the first and/or second channel sections.

Said plurality of article supports are preferably permanently secured to one another. For example, said plurality of article supports may comprise a unitary piece of material which has been bent (or otherwise formed) to define said article supports.

Where the article supports of the tiered arrangement include a first limb, said support means is preferably arranged to engage the tiered arrangement at a position below the first limb of the uppermost article support. Said support means may be arranged to abut a lower surface of a base member of a said article support. Said support means may also be arranged to abut a rearwardly facing surface of a said first limb of said article support.

Where the article supports define first and second channel sections with a gap being defined therebetween, said support means is preferably arranged to extend into the gap.

Where the article supports define first and second channel sections, said first and second channel sections may be any adjacent channel sections of the tiered arrangement. For example, if the tiered arrangement comprises five article supports the second and third article supports may be in the form of said first and second channel sections as described above.

Said support means preferably includes bracket means arranged to be secured to the fixed structure which structure may be a wall or other upright. Preferably, said bracket means comprises first and second bracket members which may be mirror images of one another.

Said bracket means is preferably arranged to support a co-operation means of said bracket means, wherein said co-operation mean is arranged to engage the tiered arrangement as described above. Preferably, said co-operation means includes a part which is arranged to extend into a gap defined between first and second channel sections of the tiered arrangement. In a preferred embodiment, said co-operation means includes a thin flange which is arranged to extend into the gap.

Said co-operation means is preferably arranged to be releasably secured to the bracket means. For example, said bracket means and said co-operation means may include co-operable male and female elements. Said bracket means may comprise a cylindrical, preferably circularly cylindrical, member which is arranged to extend into a correspondingly shaped opening of said co-operation means.

The apparatus preferably includes restrictor means for restricting pivotal movement of the article supports relative to the support means. Said restrictor means may include a restrictor element arranged to extend between the fixed structure and the tiered arrangement at a position below the level of said support means.

Said restrictor element preferably comprises an elongate strut. Said strut is preferably arranged to engage a surface of the tiered arrangement and to extend rearwardly to engage a surface of the fixed structure. Said restrictor means preferably comprises of plurality of restrictor elements. Preferably, the apparatus is arranged so that a lowermost restrictor means does not extend below the level of a lowermost surface of a lowermost article support of the apparatus.

The invention extends to an assembly of a display apparatus, the assembly comprising a plurality of elongate article supports for supporting articles to be displayed, said article supports defining a tiered arrangement and having an upper end and a lower end, support means being secured relative to a fixed structure and engaging the tiered arrangement at a position below the upper end thereof in order to support the tiered arrangement against downwards movement.

The invention extends to a plurality of article supports for a display apparatus per se, the plurality of article supports being permanently secured to one another.

The invention extends to a bracket means for supporting an article support means of a display apparatus, said bracket means being arranged to be secured to a fixed structure and including first means arranged to extend into a first gap defined by the article support means and second means arranged to support the article support means against pivotal movement.

Said first means of said bracket means is preferably arranged to extend into a gap defined between two article supports of the article support means. The two article supports suitably define a tiered arrangement and the gap may suitably be defined between adjacent limbs of the two article supports. The gap is preferably downwardly open.

Said bracket means may include a third means arranged to extend into a second gap defined by the article support means. The second gap is suitably defined at an upper end of the article support means, for example by means of a hook-shaped end region thereof.

Said first means and/or said third means when provided preferably comprise flanges. Said first means and/or said third means is/are preferably substantially planar. Said first means preferably extends substantially parallel to said third means.

Said first means and/or said third means when provided preferably include restrictor means, for example in the form of a projection, for restricting disengagement of said first means and/or said third means from out of the gap(s) defined by the article support means.

Said second means preferably includes a surface arranged to about the article support means, suitably a downwardly facing surface thereof. Said second means preferably defines a seat arranged to cooperate with a part of said article support means for seating the part thereon. Said second means is preferably arranged to abut a back part of said article support means. Said seat is preferably arranged to abut a base part of said article support means.

Said second means may be arranged to cooperate with a first article support with which said first means is also arranged to cooperate. A fourth means having any relevant feature of the second means described herein may be arranged to cooperate with a second article support with which said third means, where provided, is also arranged to cooperate.

Said bracket means is preferably arranged to cooperate with at least two tiers of the article support means.

Said bracket means is preferably a unitary component. It is suitably formed from a single piece of metal.

The invention extends to a display apparatus comprising an article support means and a bracket means, said bracket means being arranged to be secured relative to a fixed structure and including first means extending into a gap defined by the article support means and second means supporting the article support means against pivotal movement.

Any feature of any aspect of the invention may be combined with any feature of any other aspect of the invention.

Specific embodiments of the invention will now be described, by way of example, with reference to the accompanying diagrammatic drawings, in which.

In the figures, the same or similar parts are annotated with the same reference numerals.

Figure 1:
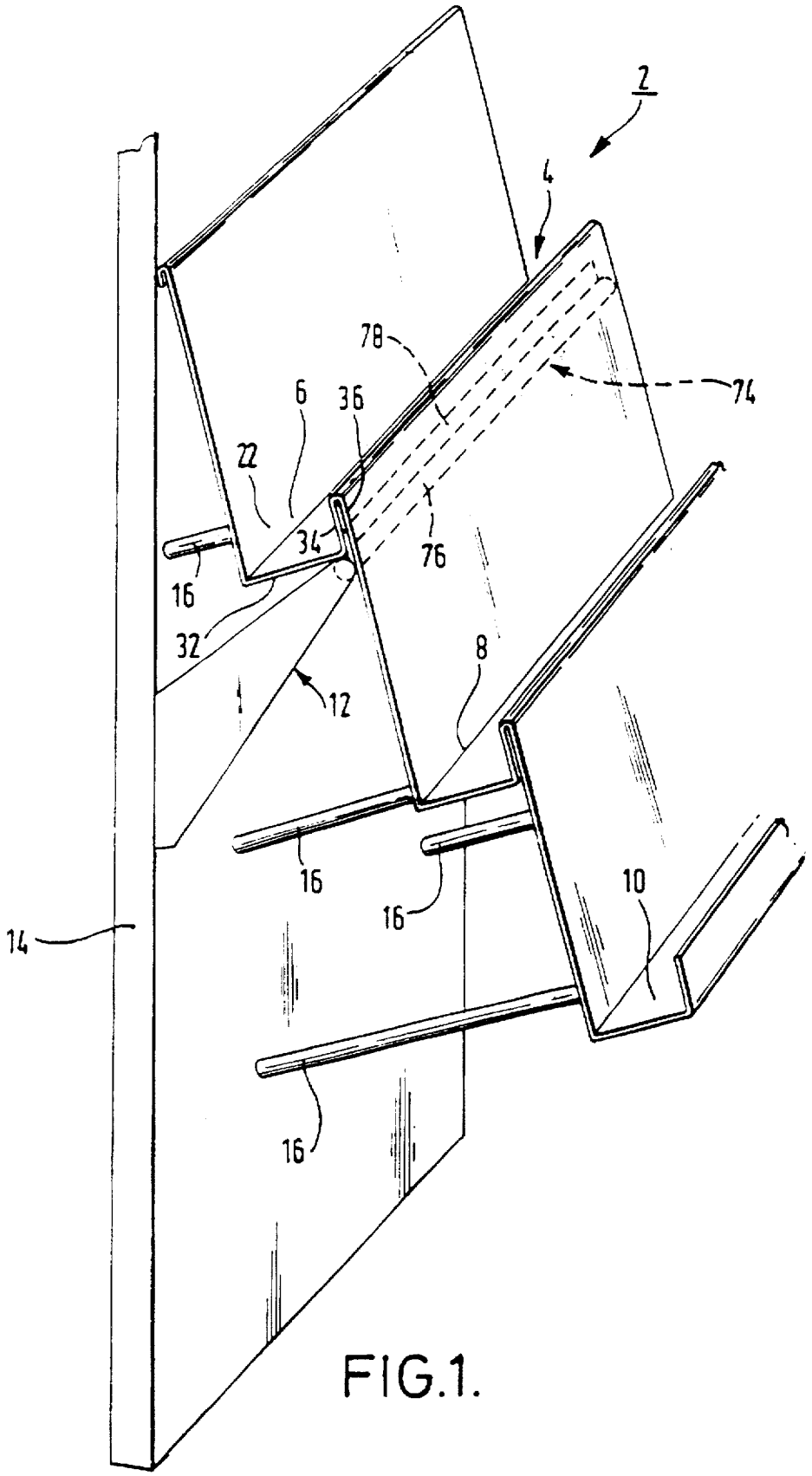
FIG. 1 is a perspective view of an assembled display apparatus.

The display apparatus 2 comprises a cascading display device 4 which defines three elongate channels 6, 8, 10 in which articles, for example magazines or newspapers, may be arranged and displayed. The display device 4 is supported by a support device 12 which extends between a rear wall 14, situated behind the device 4, and the display device and is arranged to support the display device against downwards movement. Support rods 16 extend between the wall 14 and the display device 4 and are arranged to space the display device 4 from the wall 14; to prevent the display device 4 from pivoting about the support device 12; and to add rigidity to the display apparatus.

The display apparatus 2 is described in greater detail below.

Figure 2:
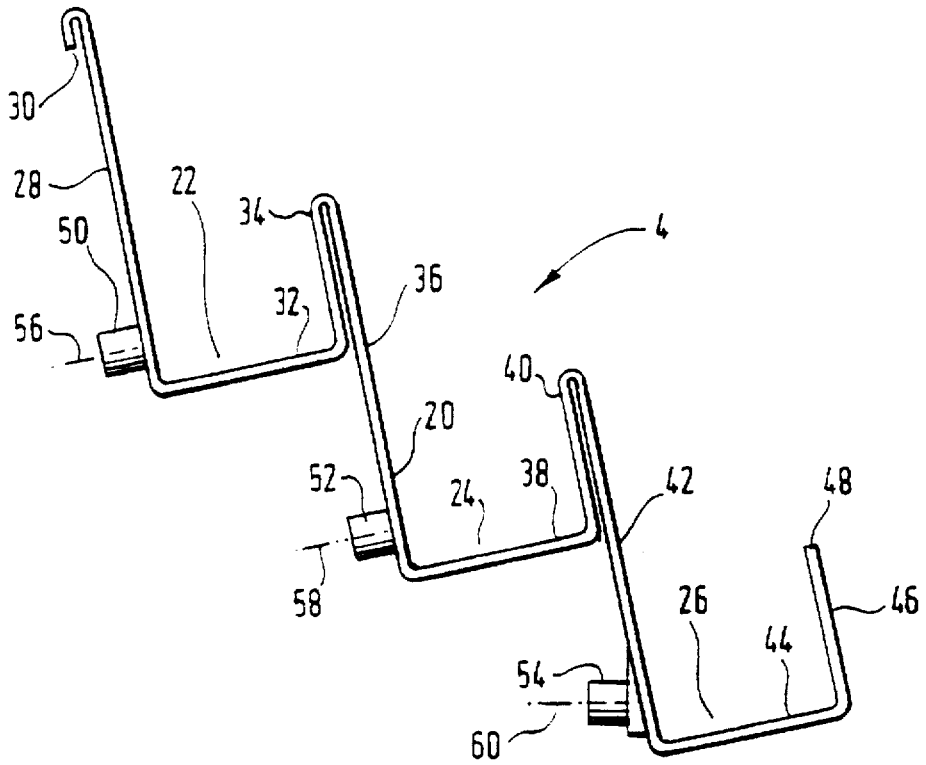
FIG. 2 is a side elevation of a cascading display device of the apparatus.

The cascading display device 4 of the apparatus 2 is shown in FIG. 2. The device 4 comprises a single piece 20 of plastics material which is bent so as to form the convoluted cascading profile shown in FIG. 2. Thus, the profile defines three channel sections 22, 24, 26. The uppermost channel section comprises a longer limb 28, having a hook 30 at its free end, a base part 32 which extends substantially perpendicularly to the longer limb 28 and a shorter limb 34 which extends perpendicularly upwardly from the base part 32.

The upper end of the shorter limb 34 is turned back upon itself through 180° so as to define a continuum with longer limb 36 of channel section 24.

The channel section 24 also includes a base part 38 and a shorter limb 40. The shorter limb 40 defines a continuum with longer limb 42 of channel section 26. Channel section 26 includes a base part 44 and shorter limb 46 having a free end 48.

Circular cross-section sockets 50, 52, 54 are fixed to the rearwardly facing surfaces of the longer limbs 28, 36, 42 respectively. Each rearwardly facing surface carries at least two sockets at horizontally spaced apart positions. The actual number of sockets provided on each longer limb depends upon the length of the display device 4.

Sockets 50, 52 have respective axes 56, 58 which extend perpendicularly to the plane of the longer limbs 28, 36, whereas axis 60 of the socket 54 extends at an acute angle to the main plane of the longer limb 42.

The sockets 56, 58, 60 are arranged to releasably secure ends of support rods 16 in position. Preferably, the ends of the support rods are an interference fit in the sockets.

Figure 3:
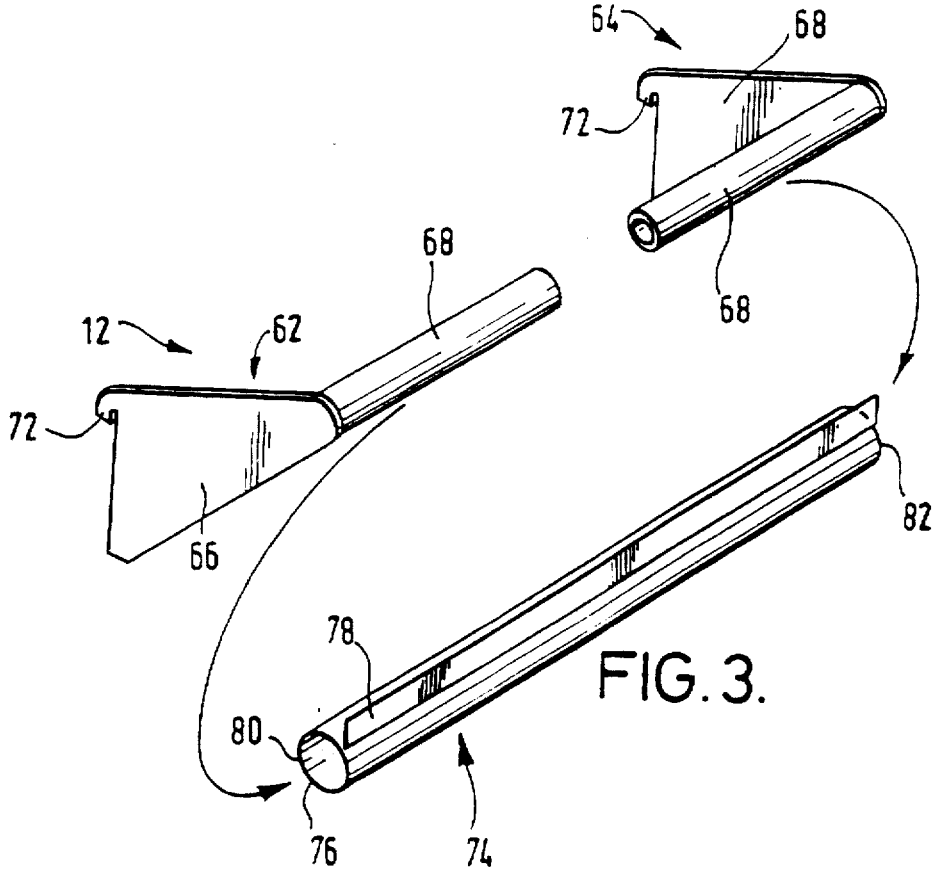
FIG. 3 is an exploded view of a support device of the apparatus.
Figures 4, 7:
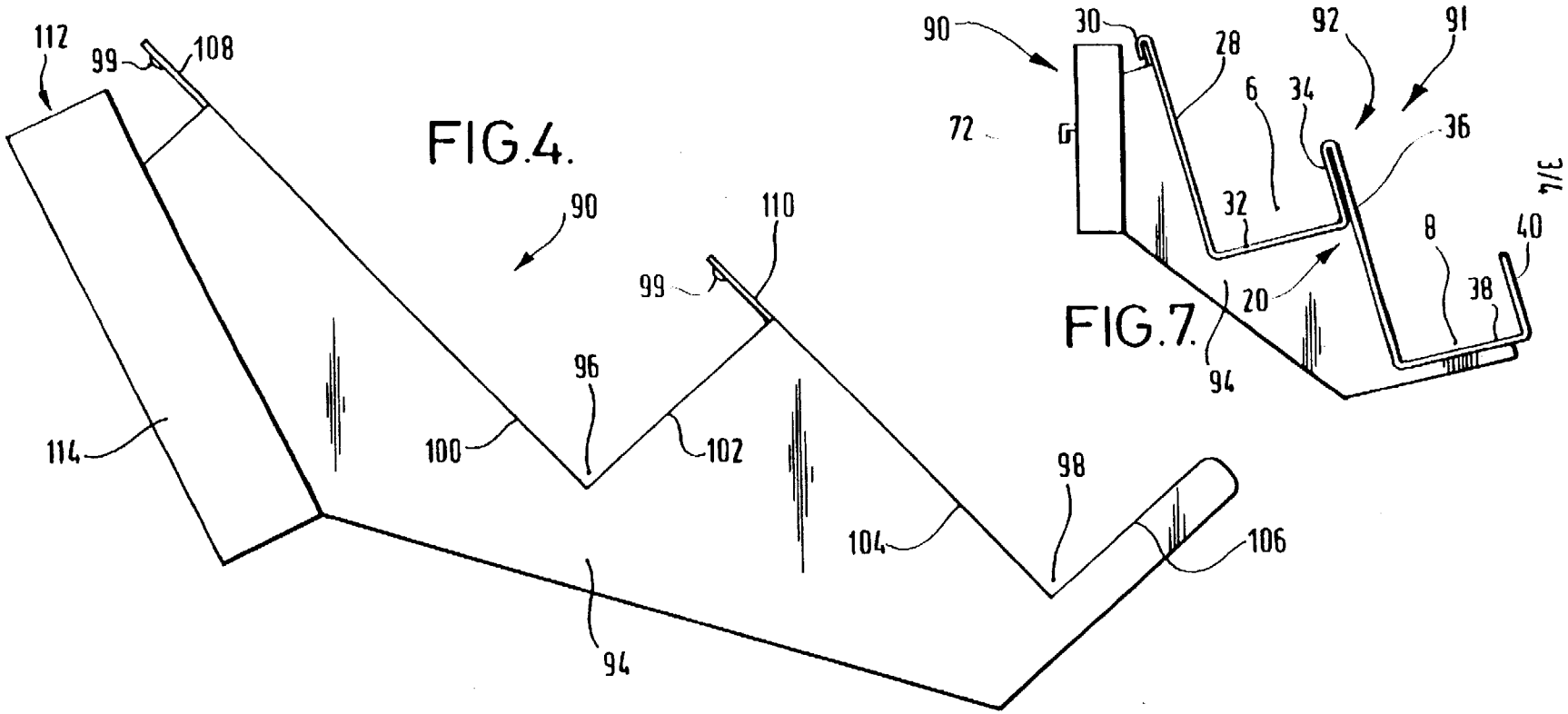
FIG. 4 is a side elevation of a bracket of an alternative display apparatus.
FIG. 7 is a side elevation of a display apparatus including the bracket of FIGS. 4 to 6.
Figure 5:
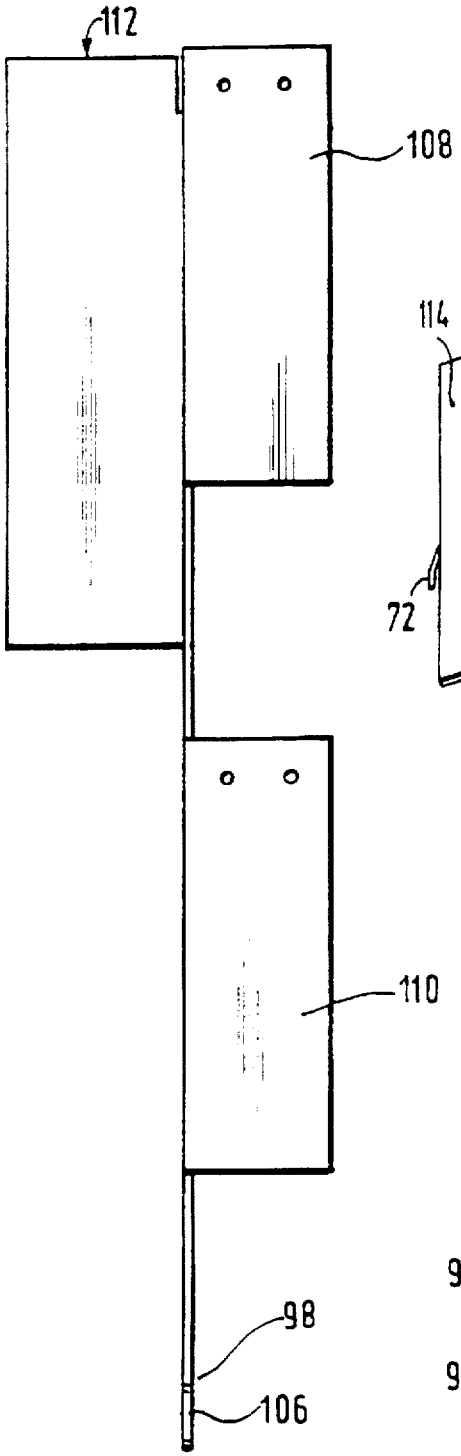
FIG. 5 is a front elevation of the bracket of FIG. 4.
Figure 6:
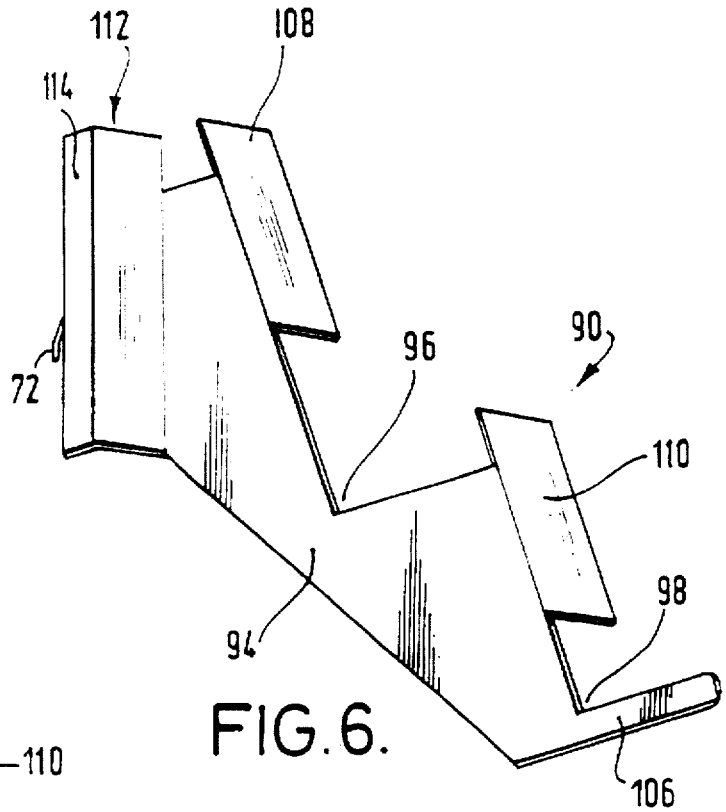
FIG. 6 is a front perspective view of the bracket of FIGS. 4 and 5 on a reduced scale.
Figure 8:
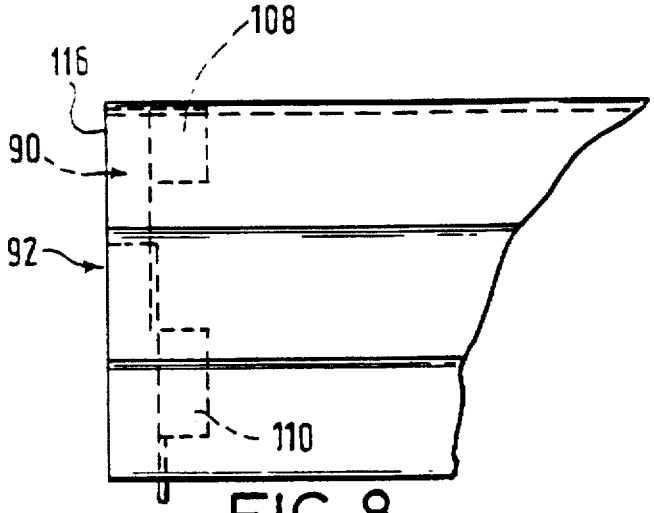
FIG. 8 is a front elevation, partly in cross-section, of part of the display apparatus of FIG. 7.

The support device 12 shown in FIG. 3 comprises spaced apart metal brackets 62, 64 which are mirror images of one another. Each of the brackets 62, 64 includes a generally trigonal planar part 66 and a circularly cylindrical tubular part 68 which extends perpendicular to the planar part from a position adjacent a forward edge thereof. A rearwardly facing side of each part 66 is provided with a hook arrangement 72 by means of which the brackets 62, 64 can co-operate with suitable fixings on the rear wall 14 in order to secure the brackets 62, 64 in position.

The support device 12 also includes an elongate tubular support strut 74. The strut 74 is made from a single rectangular piece of steel which is formed and fixed so as to define a circularly cylindrical tube part 76 from which an elongate support flange 78 extends. The flange 78 is rigidly fixed relative to the tube part 76.

The cylindrical tubular parts 68 of the brackets 62, 64 and the tube part 76 of the strut 74 are arranged so the tube parts 68 are a sliding fit in respective opposing ends of the tube part 76.

The display apparatus 2 is assembled as follows.

Firstly, respective tubular parts 68 of the brackets 62, 64 are slid into opposing ends 80, 82 of the tube part 76 of strut 74, in order to pre-assemble the support device 12. The hook arrangements 72 of the support device 12 are then engaged with corresponding fixings on the wall 14, in order to secure the support device 12 in position.

When secured in position, the brackets 62, 64 and strut 74 define a support device 12 which is a rigid arrangement.

Next, cascading display device 4 is fixed to the support device 12. To this end, the display device 4 is arranged so that the support flange 78 of the strut 74 is just below a position between shorter limb 34 of channel section 22 and the longer limb 36 of channel section 24. Then, the device 4 is urged downwardly so that the support flange 78 extends between the limbs 34, 36. The device 4 is moved downwardly until tubular parts 68 of metal brackets 62, 64 abut both the lower surface of the base part 32 and the rearwardly facing surface of the longer limb 36.

When device 4 is in position, hook 30 of device 4 may suitably abut wall 14.

Support rods 16 are then cut to an appropriate size and one is engaged with each socket 56, 58, 60 so as to extend between the wall 14 and display device 4. It will be appreciated that with the support rods in position, the display device 4 cannot pivot in a clockwise direction about strut 74. Also, since hook 30 abuts wall 14, the device cannot pivot in an anti-clockwise direction about strut 74.

It should be noted that support rods 16 which engage sockets 50, 52 will define an acute angle to the wall 14, whereas socket 54 is arranged so that a rod engaged therewith defines an angle of about 90° to the wall. This allows a second display apparatus 2 to be positioned closely below the apparatus 2.

The apparatus 2 may readily be adapted so that two display devices 4 may be disposed side by side so that there is continuity between adjacent channel 22, 24, 26 of the devices. To this end, provided brackets 62, 64 for one display device 4 are in line with brackets 62, 64 for the other display device 4, the channels of the two devices will be aligned, irrespective of the loads being carried by the respective devices.

Referring now to FIGS. 4 to 8, an alternative display apparatus 91 includes a bracket 90 which supports cascading display device 92.

The display device 92 is similar to the display device 4 except that it includes two elongate channels 6, 8 (although more may be provided if desired) and does not include sockets 50, 52, 54.

The bracket 90 is formed from a single piece of steel plate. It comprises a planar section 94 which defines a first seat 96 and a second seat 98 each of which defines a seat which is perpendicular in cross-section. The first seat 96 is defined between parts 100, 102 of the planar section 94 and the second seat 98 is defined between part 104 and a leg 106 of the section 94. First and second flanges 108, 110 extend at 90° from one side of the planar section 94 above the respective seats 96, 98. Each of the flanges includes a pair of inwardly projecting pips 99 which are formed by indenting the steel of the flanges. An L-cross-section support member 112 extends at 90° from the other side of the planar section 94. The support member 112 includes a planar face 114 which extends parallel to the planar section 94. A hook arrangement 72 extends from face 114 for fixing the bracket 90 to a wall.

The display apparatus 91 includes two brackets 90 which are mirror images of one another. Each of the brackets is secured to the display device by engaging hook 30 of the display device 92 with the first flange 108 and engaging the second flange 110 in the gap defined between limbs 34, 36 of the display device such that planar face 114 of the bracket 90 is substantially flush with end 116 of the display device. When so disposed, the first elongate channel 6 rests upon and is supported by the first seat 96 and the second elongate channel 8 rests upon and is supported by the second seat 98. Once assembled, the display device 92 and bracket 90 are relatively securely engaged with one another by virtue of the fact that the pips 99 tend to wedge flanges 108, 110 in position.

The assembled display apparatus 91 may be supported on a wall via its hook arrangements 72. When so supported, the weight of the apparatus causes planar face 114 of each bracket 90 to make face to face contact with the wall.

The apparatus 2, 91 described may be advantageous for a number of reasons. For example, since the support device 12/brackets 90 support the display device 4, 92 at a position below hook 30, the apparatus is more stable and less prone to failure under heavy loads. Also, as a consequence of the positioning of the support device 12/brackets 90 relative to the device 4, 92, the device 4, 92 tends not to sag under heavy loads and consequently two or more display devices 4, 92 may readily be arranged one above the other or side by side. In the case of the apparatus 91, the display device 92 is further supported on seats 96, 98 defined by the bracket 90. Furthermore, since display device 4, 92 is made in one piece, it does not have sharp edges and, accordingly, damage to articles, for example magazines, as they are inserted into and removed from the channels of the device may be minimized.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

We claim:

1. A display apparatus, comprising:

(a) a one-piece unitary member forming a plurality of elongate article supports for supporting articles to be displayed, said article supports being arranged to define a tiered arrangement having an upper end each and a lower end, said article support further including a channel section, each article support having a downwardly open elongate gap having an axis of elongation being defined between said sections; and (b) support means for supporting the tiered arrangement against downwards movement, said support means being arranged to be secured relative to a fixed structure and said support means being engaged in said elongate gap by movement of the tiered arrangement in a direction transverse to said elongate axis towards said support means.

2. A display apparatus according to claim 1, wherein said members forms at least a third article support which includes a channel section and a further elongate gap said support means being arranged to extend into the further elongate gap.

3. A display apparatus according to claim 1, wherein said support means is arranged to abut a lower surface of a base member of a said article support and a rearwardly facing surface of a first limb of said article support.

4. A display apparatus according to claim 1, and including restrictor means for restricting pivotal movement of the article supports relative to the support means.

5. A display apparatus according to claim 1, and including a bracket means which incorporates said support means and includes a restrictor means for restricting pivotal movement of the article supports relative to the support means.

6. An assembly of a display apparatus, comprising:

(a) a one-piece unitary member forming a plurality of elongate article supports for supporting articles to be displayed, said article supports defining a tiered arrangement having an upper end and a lower end, each said article support further including a channel section having a downwardly open elongate gap having an axis of elongation being defined between said section, each article support and (b) a support means supporting the tiered arrangement against downwards movement, said support means being secured to an upright fixed structure and being engaged in said elongate gap.

7. A method of assembling a display apparatus which comprises a a one-piece unitary member forming plurality of article supports for supporting articles to be displayed, said article supports being arranged to define a tiered arrangement having an upper end and a lower end, each said article support including a channel section each article support with a downwardly open elongate gap having an axis of elongation being defined between said sections, and a support means for supporting the tiered arrangement against downwards movement, the method comprising the steps of:

(a) securing said support means to a fixed structure; and (b) moving the tiered arrangement in a direction transverse to its elongate axis towards said support means so that said support means is engaged in said downwardly open elongate gap defined between said channel sections of the tiered arrangement.

* * * * *